US009567117B2

(12) United States Patent
Duverger

(10) Patent No.: US 9,567,117 B2
(45) Date of Patent: Feb. 14, 2017

(54) DEVICE AND METHOD FOR FILLING A CONTAINER

(71) Applicant: L'OREAL, Paris (FR)

(72) Inventor: Guillaume Duverger, Paris (FR)

(73) Assignee: L'OREAL, Paris (FR)

( * ) Notice: Subject to any disclaimer, the term of this patent is extended or adjusted under 35 U.S.C. 154(b) by 80 days.

(21) Appl. No.: 14/647,951

(22) PCT Filed: Nov. 22, 2013

(86) PCT No.: PCT/EP2013/074504

§ 371 (c)(1),
(2) Date: May 28, 2015

(87) PCT Pub. No.: WO2014/079980

PCT Pub. Date: May 30, 2014

(65) Prior Publication Data

US 2015/0321773 A1 Nov. 12, 2015

Related U.S. Application Data

(60) Provisional application No. 61/756,058, filed on Jan. 24, 2013.

(30) Foreign Application Priority Data

Nov. 26, 2012 (FR) ..... 12 61249

(51) Int. Cl.
*B65B 1/04* (2006.01)
*B65B 3/12* (2006.01)
(Continued)

(52) U.S. Cl.
CPC ..... *B65B 3/12* (2013.01); *A45D 40/00* (2013.01); *B65B 37/06* (2013.01); *B65B 37/14* (2013.01);
(Continued)

(58) Field of Classification Search
CPC ..... B65D 25/40; A61K 8/03; B65B 37/06; B65B 39/00; B65B 3/12; B65B 2220/14
See application file for complete search history.

(56) References Cited

U.S. PATENT DOCUMENTS 4,159,028 A 6/1979 Barker et al.
6,516,838 B2 2/2003 Thibiant et al.
(Continued)

FOREIGN PATENT DOCUMENTS

DE 202004020481 U1 7/2005
FR 2497728 A 7/1982
(Continued)

OTHER PUBLICATIONS

International Search Report for PCT/EP2013/074504 mailed Feb. 13, 2014.
(Continued)

*Primary Examiner* — Jason K Niesz
(74) *Attorney, Agent, or Firm* — The Marbury Law Group, PLLC

(57) ABSTRACT

The invention relates to an assembly for filling a container with at least a first product which is viscous during the filling operation, the assembly comprising a reservoir for storing the first product, a mechanism for pumping the first product from the reservoir to a distribution chamber, ducts connecting the reservoir to the pumping mechanism and the pumping mechanism to the distribution chamber, and a filling device comprising at least two dispensing spouts, each spout being in the form of a tube which is fixed at the upstream end to the distribution chamber and has an inlet orifice that opens into the distribution chamber and an outlet orifice that opens out at the free end of the spout in order to fill a container.
(Continued)

According to the invention, the at least two spouts are designed to deliver the first product at different flow rates from one another.

14 Claims, 2 Drawing Sheets

(51) Int. Cl.

| | |
|---|---|
| ***B65B 37/14*** | (2006.01) |
| ***B65B 39/00*** | (2006.01) |
| ***B65B 43/52*** | (2006.01) |
| ***A45D 40/00*** | (2006.01) |
| ***B65D 25/40*** | (2006.01) |
| ***B65B 37/06*** | (2006.01) |
| ***B65B 43/62*** | (2006.01) |
| ***B65B 63/08*** | (2006.01) |

(52) U.S. Cl.
CPC ..... *B65B 39/007* (2013.01); *B65B 43/52* (2013.01); *B65B 43/62* (2013.01); *B65B 63/08* (2013.01); *B65D 25/40* (2013.01); *B65B 2039/009* (2013.01); *B65B 2220/14* (2013.01)

(56) References Cited

U.S. PATENT DOCUMENTS

2008/0041490 A1 2/2008 Togni
2014/0326360 A1* 11/2014 Ammann ..... B65B 43/59 141/9

FOREIGN PATENT DOCUMENTS

WO 01/91605 A1 12/2001
WO 2006/125663 A1 11/2006
WO 2012/015796 A2 2/2012

OTHER PUBLICATIONS

English language abstract for DE 202004020481U1 (Jul. 7, 2005).
English language abstract for FR 2497728A (Jul. 16, 1982).

* cited by examiner

DEVICE AND METHOD FOR FILLING A CONTAINER

This is a national stage application of PCT/EP2013/074504, filed internationally on Nov. 22, 2013, which claims priority to U.S. Provisional Application No. 61/756,058, filed on Jan. 24, 2013; as well as French Application 1261249, filed on Nov. 26, 2012.

The present invention relates to an assembly for filling and a method for filling a container in particular with a cosmetic product.

The invention relates more particularly to an assembly for filling and a method for filling with two visually distinct products so as to form a pattern in the container with these two products.

The expression "cosmetic product" is understood to mean any product as defined in Regulation (EC) No 1223/2009 of the European Parliament and Council of 30 Nov. 2009 relating to cosmetic products.

U.S. Pat. No. 6,516,838 B2 discloses an assembly for filling a container with two visually distinct products. This assembly has an identical filling spout for each product. During the filling operation, a relative movement of the container with respect to the spouts makes it possible to produce a pattern with a single helix.

Similarly, document WO 2012/015796 A2 discloses an assembly for filling a container with at least two different products which are viscous when dispensing takes place in the hot state and then solidify on cooling. One and the same product may be dispensed through two identical spouts, each being connected to its own reservoir. Thus, this assembly is relatively expensive to employ and cannot create a complex pattern.

US 2008/0041490 A1 also discloses a spout for filling a container with at least two products. This spout comprises concentric ducts, each being connected to a product reservoir. This device cannot create complex patterns.

Document U.S. Pat. No. 4,159,028 discloses a filling device having a single spout that dispenses two distinct products. Consequently, it is impossible to create a pattern in a controlled and repeatable manner from one filling operation to another.

Finally, document WO 2006/125663 A1 discloses a filling device comprising a spout for dispensing a product that opens out at the downstream end through two identical channels. During the filling operation, the pattern created has two phases of this product with the same size. Thus, this device cannot produce more complex patterns with layers of one and the same phase having different sizes.

A need thus exists to fill containers with at least two products, producing complex patterns by means of a simple filling assembly.

The object of the present invention is thus to provide an improved filling assembly in order to alleviate in particular the abovementioned drawbacks.

To this end, the invention proposes an assembly for filling a container with at least a first product which is viscous during the filling operation, the assembly comprising a reservoir for storing the first product, a mechanism for pumping the first product from the reservoir to a distribution chamber, ducts connecting the reservoir to the pumping mechanism and the pumping mechanism to the distribution chamber, and a filling device comprising at least two dispensing spouts, each spout being in the form of a tube which is fixed at the upstream end to the distribution chamber and has an inlet orifice that opens into the distribution chamber and an outlet orifice that opens out at the free end of the spout in order to fill a container.

According to the invention, the at least two spouts are designed to deliver the first product at different flow rates from one another.

According to further features of the invention, the outlet orifices of the at least two spouts may have sections having different sizes from one another.

The ratio between the flow rate and the section of the outlet orifice of each of the spouts may be approximately equal for all of the spouts.

The outlet orifices of the at least two spouts may have circular sections with different diameters.

At least one section upstream of the outlet orifice of each of the at least two spouts may have a different section from the section of the outlet orifice.

The spout in which the section of the outlet orifice has a larger size may have a section upstream of the outlet orifice having a size smaller than that of said outlet orifice.

The spout in which the section of the outlet orifice has a smaller size may have a section upstream of the outlet orifice having a size larger than that of said outlet orifice.

The section having a different size upstream of the outlet orifice may be the section of the inlet orifice.

The at least two spouts may be heated during the filling operation.

At least one spout may have a frustoconical portion and/or a narrowing.

The invention also relates to a filling device for an above-described assembly, designed to dispense into a container a product which is viscous during the filling operation, having at least two dispensing spouts, each spout being in the form of a tube having an inlet orifice and an outlet orifice at the free end of the spout, the outlet orifices of the at least two spouts having different sections from one another.

The invention also relates to a method for filling a container with at least a first product and a second product which are viscous during the filling operation and are visually distinct, having the following steps of:

- storing each product in a storage reservoir;
- conveying the first product towards a first filling device by means of a single first pumping mechanism;
- conveying the second product towards a second filling device by means of a second pumping mechanism;
- dispensing the first product into the container via the first filling device having at least two dispensing spouts that are designed to deliver the first product at different flow rates from one another;
- before or at the same time as the first product is dispensed, dispensing the second product into the same container via the second filling device having at least one dispensing spout.

The method may comprise a step of setting the container into relative movement with respect to at least the first filling device while the first product is being dispensed.

Finally, the invention also relates to a finished product comprising a container filled with a first product and a second product by means of the above method, the finished product comprising at least two layers of first product having different sizes.

The invention will be understood better from reading the following description of non-limiting examples of the implementation thereof with reference to the appended drawings, in which:

FIG. 1 schematically shows a filling assembly according to the invention;

Figure 1:
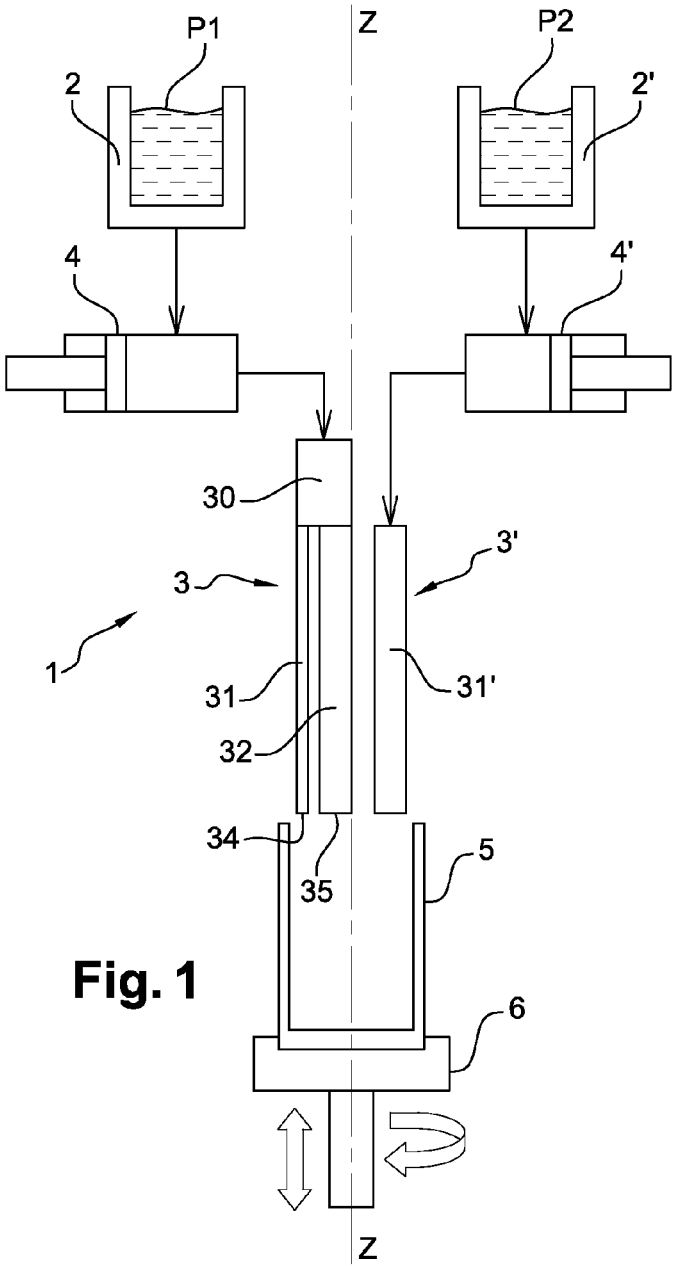

Throughout the following text, the terms "upstream" and "downstream" are understood generally to mean with respect to the normal direction of circulation of a fluid, in particular a cosmetic fluid.

The products (P1, P2) used to fill one and the same container 5 are for example cosmetic products such as care products or makeup products. These products are visually different from one another. A first product P1 may in particular be coloured and a second product P2 may be transparent. As a variant, the first product P1 may also be transparent like the second product P2 but the first product P1 then comprises glitter in order to distinguish it from the second product.

During filling and storage in the container 5, the products have sufficient viscosity to maintain their distribution in a stable manner in contact with one another. Thus, the products have rheologies such that they do not mix with one another without mechanical action inside the container, but may easily be mixed homogeneously, by virtue of compatible textures, on leaving the container just prior to application and should, once mixed, have good cosmetic properties.

The viscosity selected should as far as possible avoid flowing and unintentional mixing of the compositions.

First Technique for Measuring the Viscosity

Very low shear viscosity characterizes the texture of the product at rest or almost at rest.

The measurements are taken at 25° C. using a TA Instrument ARG2 imposed-stress rheometer equipped with a cone-plate measuring body fitted with an anti-evaporation device in the form of a bell jar.

For each measurement, the sample is placed delicately in position and the measurements start 5 minutes after placing the sample in the jaws. The product is then subjected to a stress ramp from $10^{-3}$ Pa to $10^{2}$ Pa at a set frequency of 1 Hz.

At 25° C., the first and/or the second product preferably have a low shear viscosity, that is to say a viscosity at 0.010 $s^{-1}$ greater than or equal to 200 Pa·s and preferably between 200 Pa·s and 5000 Pa·s, in particular between 200 Pa·s and 2000 Pa·s, or between 200 Pa·s and 1000 Pa·s.

Second Measuring Technique: Viscosity Using a Rheomat at 25° C.

The viscosity is measured at 25° C., using a Rheomat RM180 viscometer equipped with a No. 4 (M4) or No. 3 (M3) spindle, the measurement being performed after 10 minutes of rotation of the spindle in the product (after which time stabilization of the viscosity and of the spin speed of the spindle are observed), at a shear rate of 200 $s^{-1}$. A measurement in DU (deviation units) is obtained.

The viscosity of the products is preferably greater than 15 DU M3, in particular greater than 20 DU M3. The following are examples of viscosities of products that can be used in the containers filled using the filling device of the invention: a foundation having a viscosity ranging from 10 DU M4 to 75 DU M4 or from 25 to 35 DU M4, a moisturising cream having a viscosity ranging from 35 to 68 DU M3, a serum having a viscosity ranging from 50 to 80 DU M3, a gel having a viscosity ranging from 35 to 60 DU M3, or a self-tanning cream having a viscosity ranging from 15 to 25 DU M3, this list not being limiting.

Thus, each product may be in a viscous form at ambient temperature, for example in the form of a gel or a paste.

As a variant, each product may be in a solid form at ambient temperature but a viscous form at a higher temperature. In this case, the products are heated in order to fill the container and then cooled until they solidify in the container. The heating means modify the temperature of the product in order to obtain a viscosity suitable for filling.

The container 5 is designed to contain the products (P1, P2). The container may be a flexible tube of a type known to a person skilled in the art Advantageously, the container 5 is in the form of a semi-rigid or rigid tube equipped with a pump and a follower piston. The pump, which is conventionally housed in a dispensing head, is positioned on the container 5 after filling in order to close the container 5.

Preferably, the walls of the container 5 are transparent so that the products (P1, P2) contained in said container 5 can be seen.

A filling assembly 1 will be described with reference to FIG. 1.

The first and the second product (P1, P2) described above are stored in two different reservoirs (2, 2') prior to filling.

Such reservoirs (2, 2') may be equipped with heating means and/or mixing means in order to homogenize the products and obtain a viscosity suitable for good filling.

Each of the products (P1, P2) is transferred from its reservoir to a first and a second filling device (3, 3'), respectively, by virtue of pumping means (4, 4').

Each reservoir (2, 2') is connected to a pumping means (4, 4') which is itself connected to a filling device (3, 3') by lines through which the streams of products flow.

The pumping means (4, 4') are of a type known to a person skilled in the art of filling machines. These pumping means may be piston pumps for example.

Pressure sensors and/or flow rate sensors (not shown) make it possible conventionally to control the pumping means (4, 4) in order to modify the stream of each product during the filling operation.

The filling devices (3, 3') are fixed, but as a variant, these filling devices may be mounted so as to be able to move for example in rotation or in translation along a longitudinal axis Z-Z. As a variant, the filling devices (3, 3') may also be mounted so as to be able to move in translation along perpendicular axes X-X and Y-Y that define a plane orthogonal to the axis Z-Z.

The filling devices are typically dispensing spouts in the form of a tube extending parallel to a longitudinal axis Z-Z. These dispensing spouts may be produced from any material, for example from metal, such as stainless steel, or from thermoplastic material. The spouts are connected at the upstream end to the pumping means, and their downstream end is free so as to pass into the container 5 for the filling operation. The dispensing spouts may be heated in order to regulate the temperature of the product delivered during the filling operation.

The second product P2 is dispensed through a single dispensing spout 31' connected directly to the upstream pumping means 4' via a line.

According to the invention, the first product P1 is for its part dispensed into the container 5 by means of a first filling device 3 having a plurality of spouts, for example two spouts (31, 32), as shown in FIG. 1, or more, depending on the pattern that is desired to be produced in the container 5. For example, in FIG. 3 the filling device has three spouts (31, 32, 33).

The two spouts (31, 32) of the first filling device 3 are connected at the upstream end to the distribution chamber 13 which receives the stream of first product P1 coming from the pumping means 4.

Thus, the distribution chamber 30 is a closed volume having an inlet for product coming from the pumping means and an outlet through a filling spout (31, 32, 33).

The dispensing spouts (31, 32, 33) for the first product P1 may be positioned alongside the dispensing spout 31' for the second product P2, as is shown in FIG. 1. As a variant (not shown), the dispensing spouts (31, 32, 33) for the first product P1 may be positioned inside the tube forming the dispensing spout 31' for the second product P2. Thus, the second product P2 is dispensed around the dispensing spouts (31, 32, 33) for the first product P1.

Each spout (31, 32) thus has an inlet orifice in the region of the distribution chamber and an outlet orifice at the free end of the tube forming the spout.

At least two spouts (31, 32) connected to the distribution chamber 30 respectively have outlet orifices (34, 35) having different sections from one another. The sections of the outlet orifices (34, 35) may differ in terms of their shape or their size. The difference in section makes it possible to deliver the first product P1 into the container at two different locations and two different flow rates.

In the example illustrated, the outlet orifices of the spouts are circular and have different diameters. Thus, the first spout 31 may have an outlet orifice 34 having a diameter of between 1 mm and 9 mm, advantageously between 1 mm and 3 mm, for example equal to 2 mm. The second spout 32 may have an outlet orifice 35 having a diameter larger than that of the first spout 31, for example between 2 mm and 10 mm, advantageously between 3 mm and 6 mm, for example equal to 4 mm.

Figure 3:
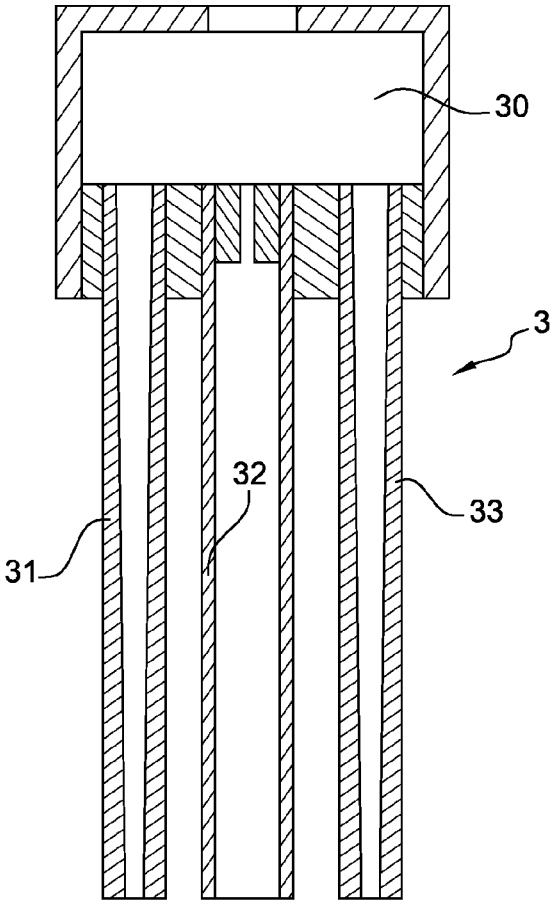
FIG. 3 shows a variant of the device from FIG. 2 connected to a distribution chamber.

The variant of the filling device shown in FIG. 3 differs from that in FIG. 1 in that it has a third spout 33 identical to the first spout 31 but different from the second spout 32. As a variant, all of the spouts of the filling device 3 may be different.

On account of the pressure drops caused by the difference in sizes between the different dispensing spouts (31, 32) of the first filling device 3, and in order to avoid the situation in which the stream of the first product P1 chooses a preferential passage from the distribution chamber 30 to the second spout 32, which has the largest outlet orifice 35, at least one upstream section of the outlet orifice, for example the section of the inlet orifice, of the spout 32, which has the largest outlet orifice 35, is smaller than the section of said outlet orifice 35.

Advantageously, no section upstream of the outlet orifice 35 of the second spout 32 is larger than said outlet orifice 35.

Figure 2:
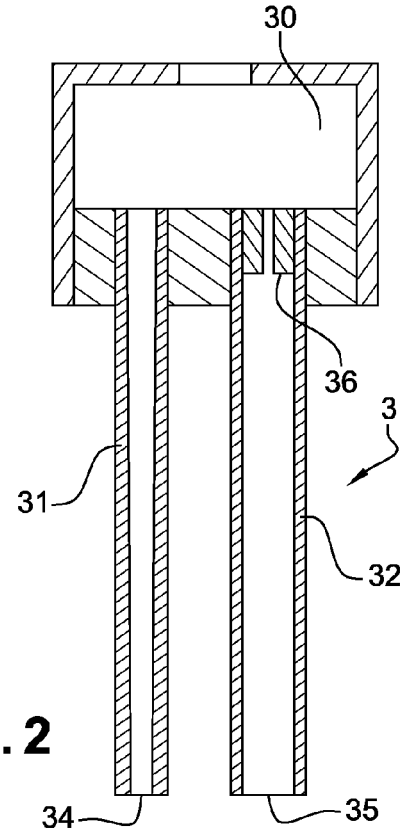
FIG. 2 shows a longitudinal section through a filling device of the assembly from FIG. 1 connected to a distribution chamber.

In this example, as can be seen in FIG. 2, the second spout 32 is substantially cylindrical and has a narrowing 36 forming the inlet orifice. As a variant, the second spout 32 may be in the form of a frustoconical tube that flares from upstream to downstream.

On the other hand, the first dispensing spout 31, the section of the outlet orifice 34 of which has a smaller size, has a section upstream of the outlet orifice 34, for example the section of the inlet orifice, having larger dimensions than those of said outlet orifice 34.

Advantageously, no section upstream of the outlet orifice 34 of the first spout 31 is smaller than said outlet orifice 34.

In this example, as can be seen in FIG. 2, the first spout 34 is in the form of a frustoconical tube that narrows from upstream to downstream. As a variant, the first spout 34 may be in the form of a substantially cylindrical tube and have a narrowing forming the outlet orifice.

The size of the section of each spout may vary locally, that is to say in a discontinuous manner, for example with a narrowing, or regularly along the axis Z-Z along the entire length of the spout, or only along a part of its length.

As a further variant, at least one of the spouts of the first dispensing device for the first product P1 may have a constant section.

Thus, the second spout 35 has a circular inlet orifice having a diameter of between 1 mm and 9 mm, advantageously between 1 mm and 3 mm, for example equal to 2 mm.

Similarly, the first spout 34 has a circular inlet orifice having a diameter of between 2 mm and 10 mm, advantageously between 3 mm and 6 mm, for example equal to 4 mm.

The inlet diameter of the spout 32 having the largest outlet orifice 35 may be approximately equal to the outlet diameter of the spout having the smallest outlet orifice 34. Conversely, the inlet diameter of the spout 31 having the smallest outlet orifice 34 may be approximately equal to the outlet diameter of the spout 32 having the largest outlet orifice 35.

Thus, the spouts of the first dispensing device 3 are dimensioned such that the pressure drops in each spout are compensated in spite of the different dimensions of the outlet orifices, and in order to obtain a ratio between the flow rate and the section of the outlet orifice of each spout that is approximately equal for all of the spouts.

This means that the dispensing speeds of each layer of first product P1 are approximately the same for each spout (31, 32), making it possible to obtain layers of first product P1 that are supported by the second product P2, it being possible for said layers to be wide or narrow, but always constant and very defined.

This device makes it possible to obtain a first layer of first product P1 having a thickness measured along the axis Z-Z greater than or equal to 3 times, better still 5 times, the thickness of a second layer of first product P1 coming from the same filling device 3.

With a view to filling, the container 5 intended to receive the first and second products is moved onto a mount 6 opposite the filling spouts for example by means of a conveyor (not shown). The container 5 is held in a fixed manner in its mount 6.

The dimensions and materials of the container 5 are selected in a manner suitable for the type of product being contained. The opening in the container 5 of longitudinal axis Z-Z is also suitable for the passage of the filling devices through said opening.

During the filling operation, the container 5 is set in motion with respect to the filling devices (3, 3'). In this example, the filling devices are fixed and the container is set in rotation about the axis Z-Z, and/or in translation along the axis Z-Z, and/or in translation along perpendicular axes X-X and Y-Y defining a plane orthogonal to the axis Z-Z. As a variant, the container may be fixed and the filling devices able to move. As a further variant, the container and the filling devices are all able to move.

Just before the filling operation starts, the container 5 is in a high position and the free ends of the spouts are positioned in the container 5 close to the bottom of said container 5. The pumping means (4, 4') are then actuated in order to simultaneously dispense the first and the second product into the container 5. As a variant, it is possible for the start and/or end of dispensing of the first product P1 and of the second product P2 not to be simultaneous.

During the filling operation, the container 5 is moved in translation in order to move the free end of the spouts away from the bottom of the container upon filling.

Figure 4:
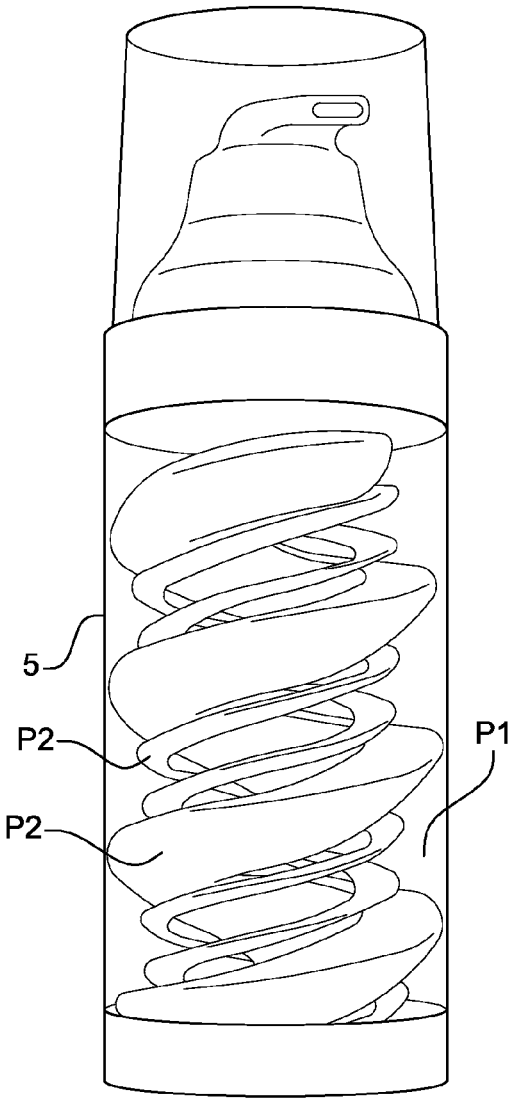
FIG. 4 shows a container filled by way of the device from FIG. 3.

Simultaneously with the translation, a rotational movement is conferred on the container in order to produce a helix-type pattern of the first product in the second product. There are as many helices as there are numbers of spouts delivering the first product P1, as can be seen on the container filled and closed by way of a dispensing head in FIG. 4.

The filling rates, the speed or direction of rotation of the container and the speed of translation of the container may vary during the filling operation in order to form different patterns.

Means for cooling the container after the filling operation may be provided in order to cool the products and solidify them, if need be.

As a variant (not shown), the container is pre-filled with the second product and the first product is injected into the second product in order to form the pattern.

The invention is not limited to the examples illustrated. The features of the various examples can in particular be combined as parts of variants which are not illustrated.

The expression "comprising a" should be understood as meaning "comprising at least one", unless specified to the contrary.

The invention claimed is:

1. An assembly for filling a container with at least a first product which is viscous during the filling operation, the assembly comprising:

a reservoir for storing the first product;

a pumping mechanism for pumping the first product from the reservoir to a distribution chamber;

ducts connecting the reservoir to the pumping mechanism and the pumping mechanism to the distribution chamber; and a filling device comprising at least two dispensing spouts;

wherein each of the at least two dispensing spouts is in the form of a tube which is fixed at the upstream end to the distribution chamber and has an inlet orifice that opens into the distribution chamber and an outlet orifice that opens out at the free end of the spout in order to fill a container; and wherein the at least two spouts are configured to deliver the first product at different flow rates from one another.

2. The assembly of claim 1, wherein the outlet orifices of the at least two spouts comprise sections having different sizes from one another.

3. The assembly of claim 2, wherein the ratio between the flow rate and the section of the outlet orifice of each of the spouts is approximately equal for all of the spouts.

4. The assembly of claim 1, wherein the outlet orifices of the at least two spouts have circular sections with different diameters.

5. The assembly of claim 1, wherein at least one section upstream of the outlet orifice of each of the at least two spouts has a different section from the section of the outlet orifice.

6. The assembly of claim 2, wherein the spout in which the section of the outlet orifice has a larger size has a section upstream of the outlet orifice having a size smaller than that of said outlet orifice.

7. The assembly of claim 2, wherein the spout in which the section of the outlet orifice has a smaller size has a section upstream of the outlet orifice having a size larger than that of said outlet orifice.

8. The assembly of claim 5, wherein the section having a different size upstream of the outlet orifice is the section of the inlet orifice.

9. The assembly of claim 1, wherein the at least two spouts are heated during the filling operation.

10. The assembly of claim 1, wherein at least one spout has a frustoconical portion and/or a narrowing.

11. The assembly of claim 1, wherein the outlet orifices of the at least two spouts have different sections from one another.

12. A method for filling a container with at least a first product and a second product which are each viscous during the filling operation, and are visually distinct, said method comprising:

storing each product in a storage reservoir;

conveying the first product towards a first filling device by means of a single first pumping mechanism;

conveying the second product towards a second filling device by means of a second pumping mechanism;

dispensing the first product into the container via the first filling device having at least two dispensing spouts configured to deliver the first product at different flow rates from one another;

before or at the same time as the first product is dispensed, dispensing the second product into the same container via the second filling device having at least one dispensing spout.

13. The filling method of claim 12, wherein the method comprises a step of setting the container into relative movement with respect to at least the first filling device while the first product is being dispensed.

14. A container comprising a first product and a second product which are each viscous and visually distinct, the container filled by a method comprising:

storing each product in a storage reservoir;

conveying the first product towards a first filling device by means of a single first pumping mechanism;

conveying the second product towards a second filling device by means of a second pumping mechanism;

dispensing the first product into the container via the first filling device having at least two dispensing spouts configured to deliver the first product at different flow rates from one another;

before or at the same time as the first product is dispensed, dispensing the second product into the same container via the second filling device having at least one dispensing spout;

wherein the first product forms at least two layers of having different sizes, each product being in a viscous form at ambient temperature.

* * * * *